United States Patent [19]

Winch

[11] 4,213,218

[45] Jul. 22, 1980

[54] IMPREGNATOR/RINSER

[75] Inventor: Allen R. Winch, Westfield, N.J.

[73] Assignee: Cotton Incorporated, New York, N.Y.

[21] Appl. No.: 18,137

[22] Filed: Mar. 7, 1979

Related U.S. Application Data

[62] Division of Ser. No. 859,167, Dec. 9, 1977, Pat. No. 4,158,237.

[51] Int. Cl.[2] ..... D06B 3/02

[52] U.S. Cl. ..... 8/151; 8/156; 8/158

[58] Field of Search ..... 68/22 R, 44, 45, 158, 68/181 R, 184; 8/156, 158, 151

[56] References Cited

U.S. PATENT DOCUMENTS

| | | | |
|---|---|---|---|
| 813,478 | 2/1906 | Zillessen | 68/184 |
| 2,539,947 | 1/1951 | De Klerk | 68/158 X |
| 2,621,506 | 12/1952 | Hopkins et al. | 68/158 |
| 3,292,397 | 12/1966 | Wooliever | 68/44 X |
| 3,332,258 | 7/1967 | Schmitz | 68/158 X |

*Primary Examiner*—Philip R. Coe

*Attorney, Agent, or Firm*—Burns, Doane, Swecker & Mathis

[57] ABSTRACT

An apparatus and method for providing an impregnation/rinsing of a web with fluid is disclosed wherein the web is repeatedly gently squeezed and allowed to open. A preforated conveyor belt carries the web within a longitudinal tank in which a series of squeeze rollers and a series of singular or cooperating rollers are arranged with the cooperating rollers being disposed intermediate the squeeze rollers. The web is carried by the conveyor belt beneath the first squeeze roller where the web is gently squeezed in a nip defined between the conveyor belt and the roller. The conveyor belt then carries the web above a cooperating roller. After the web has been gently squeezed, it is allowed to absorb the fluid in the tank without restraint until the web is gently squeezed again between the conveyor belt and the next squeeze roller. The steps of squeezing and absorbing are repeated throughout the longitudinal tank. Fluid is supplied to the longitudinal tank by one or more orifices which receive fluid from either a collection tank provided beneath the conveyor belt and longitudinal tank and/or from a supply of fresh fluid. The fluid in the tank typically travels in a path which is opposed to the general direction of travel of the web within the tank, especially when the apparatus is used as a rinser.

10 Claims, 5 Drawing Figures

IMPREGNATOR/RINSER

This is a division of application Ser. No. 859,167, filed on Dec. 9, 1977, and now U.S. Pat. No. 4,158,237.

BACKGROUND OF THE PRESENT INVENTION

The present invention relates generally to a method for use as a liquid impregnator or as a washer or rinser in the continuous wet processing treatment of fibrous assemblies, and especially for use in processing continuous nonwoven batts or webs. Such continuous textile treating processes are frequently referred to as continuous "pad-dry" processes. Generally such continuous pad-dry processes begin with a "wet-on-dry" application stage in which the fiber assembly (batt, web, or fabric), hereinafter referred to as a batt, is fed as a continuous dry fiber batt into the first liquid impregnating stage. Following this first wet-on-dry impregnation, the web batt generally passes through the nip of a pair of high expression nip rolls to reduce the liquid (i.e., the treating "liquor") pickup to some level below that present on the batt before entering the nip of the high expression paired nip rolls. The wet pickup (WPU) of liquor on the batt as it leaves the impregnation tank and before passing through the high expression paired nip rolls may be on the order of 1,000% to 4,000% (meaning 10 to 40 pounds of liquor per pound of dry fiber in the batt) depending upon the porosity, capillarity and wet bulk of the batt, the time and distance required for the batt to emerge from the impregnating bath to the high expression paired nip rolls, and the nature of the impregnating liquor.

The design of the high expression paired nip rolls and the pressure applied to the batt at the nip of the high expression paired nip rolls may be varied to obtain various levels of residual wet pickup of liquor on the batt as it leaves the paired nip rolls. The desired level of residual wet pickup depends upon the nature and purpose of the next process stage. Generally, if the next process stage is a second wet impregnation stage (and hence a "wet-on-wet" impregnation stage), it is desirable to reduce the level of residual wet pickup on the fabric by means of the high expression paired nip rolls to as low a level as practicable in order either (a) to provide for sufficient additional wet liquor pickup on the batt during the subsequent wet-on-wet impregnation, or (b) to minimize the residual wet pickup on the batt before the batt enters the dryer. If the process stage following the paired nip roll expression is a "reacting" or "aging" stage, the desired level of wet pickup on the batt leaving the high expression paired nip rolls may be higher than the minimum level which can be achieved by very high pressure expression nip rolls.

Somewhat higher residual wet pickups may be desired to provide sufficient liquid mobility throughout the large and small capillary spaces between fibers in the fibrous assembly which forms the batt. Such liquid mobility is desirable during a "reacting" or "aging" period in the process to assure good distribution of chemical reactants such as alkali, hydrogen peroxide bleaches, dyestuffs, etc., throughout the batt. Frequently, high expression of liquor at the nip of the high expression paired nip rolls just prior to the rinsing stage or between each of a series of rinsing stages is also sought in order to reduce the amount of rinsing liquid used and to improve the rinsing efficiency of each rinsing stage.

It is readily apparent that, in continuous wet chemical textile finishing or treating processes, the design and resulting efficiencies of the various liquor impregnation stages and liquor extraction stages (high expression paired nip rolls are used in this illustrative discussion to serve as the liquor extraction means) play a major role in the cost of such process equipment and the effectiveness of such process methods. In order to achieve thorough impregnation of treating liquors into textile fabrics, or thorough rinsing of residual chemicals from such treated fabrics, two or more tandem "dip and nip" impregnators or wash boxes are frequently used. And for woven fabrics, the dwell time and washing or rinsing efficiency is generally improved by increasing the path length through which the fabric must travel in the washing or rinsing liquor. To obtain sufficient path length in such wash boxes, woven fabrics travel over and under a large number of rolls spaced relatively far apart (roughly 3 to 12 feet) vertically, and relatively close together (roughly 0.5 to 1.0 foot) horizontally. In this manner, a fabric passing over, say, 31 rolls and under 30 rolls (alternately over and under one roll to the next) will travel 120 yards in a wash box measuring roughly 16 feet long×7 feet high if the rolls are spaced 6 inches apart horizontally and 6 feet apart vertically.

At high linear speeds of woven fabric traveling through the wash box plus counter current flow of wash liquor relative to the fabric travel through the wash box, good exchange of fresh rinse liquor for residual treating liquor in the fabric can be achieved. Many innovations in design of washers have been made to increase liquor penetration and exchange for both wet-on-wet impregnators and for wash boxes, with many of these designs employing means to generate turbulent liquor flow, forced flow of the liquor through the fabric as it passes over suction drums or slots, etc.

In seeking to improve the design of impregnators and wash or rinse boxes for nonwoven fiber assemblies, for example a 16 oz. per square yard carded or garnetted cotton batt, it is not practicable to attempt to pass the batt up and down long vertical distances over a series of rolls as described above for a woven fabric, since the nonwoven fabric or batt does not have enough strength to hold together as it travels long spans up and down over such a series of rolls so spaced. One alternative is to pass the nonwoven batt under a shallow immersion roll and then through the nip of a pair of squeeze rolls. However, to achieve an efficient, thorough wet-on-wet liquor exchange or rinsing effect it is necessary to pass the batt through a number of such "dip-and-nip" stages in tandem sequence with one another. By using a shallow (essentially horizontal) immersion path through each dip tank the fiber batt can be transported on one conveyor belt (rather than between two belts) with little or no risk of breaking the batt as it passes into, through, and out of the dip tank and then to the nip of the paired squeeze rolls. Unfortunately, however, the equipment cost for a multi-stage series of single-dip-single-nip wash boxes or impregnators becomes economically burdensome. A major cost factor is each pair of squeeze rolls needed for each high expression nip following each impregnation dip. During immersion, it is also important that the web be treated without a substantial stretching of the web. One way of avoiding excessive stretching of the web is to convey the web through a treatment tank in a generally longitudinal direction with relatively short up and down fluctuations in the path of the web.

Various designs for impregnators or rinsers which have been disclosed prior to the present invention are unsatisfactory since they employ either one or two conveyor belts to pass between the nip of paired high expression rolls or between stationary paired pressure plates, or they require the batt itself to pass between the nips of a series of high expression paired nip rolls to achieve satisfactory liquor exchange or rinsing efficiencies. For example, to increase the effectiveness of the action of the fluid on the web, a repetitive squeezing of the web during travel within the tank has been utilized by providing a sequence of paired squeeze rollers or stationary pairs of opposed pressure plates along the path of the web such as is shown in U.S. Pat. No. 3,681,951 issued to Chaikin et al. Other fluid treatment systems include a sequence of rollers arranged in a generally circular configuration to provide a sort of zigzag path for the web. A single conveyor belt has been used with such a roller arrangement such as is shown in the German Patent No. 1,460,397 issued to Freudenberg on May 29, 1969. In this arrangement, however, a central roller cooperates with the circular arrangement of rollers to provide a repeated paired nip roll squeezing action of the web between the central roller and adjacent rollers. The Freudenberg arrangement is also undesirable because it is unsuitable for use with a countercurrent flow.

Other attempts at providing a fluid treatment system having a series of rollers and one or more conveyor belts are described in U.S. Pat. No. 3,457,740 issued to Korsch, and U.S. Pat. No. 2,742,773 issued to Chambers et al.

However, the need still exists for an efficient, economical apparatus and method for impregnating and/or washing a nonwoven batt, particularly adapted for use in a continuous fashion.

It is an object of the present invention to provide a method which substantially avoids or alleviates the problems of the prior art.

It is an object of the present invention to provide a method for fluid treatment of a web of fibers by intermittently gently squeezing the web within a tank of fluid.

Another object of the present invention is to provide a method for fluid treatment of a web of fibers by conveying the web on a single endless belt alternately beneath a squeeze roller and above a cooperating roller.

Yet another object of the present invention is to provide a fluid treatment for a web wherein the web is conveyed on a single endless conveyor belt and travels in a generally horizontal direction so as not to be excessively stretched during the fluid treatment.

Still another object of the present invention is to provide a method for a fluid treatment of a batt in which the batt is repeatedly compressed and allowed to expand between compressions during the treatment within a tank of fluid.

An apparatus which satisfies these and other objects includes a longitudinal tank and a perforate endless conveyor belt which carries a non-woven web of fibers into the tank and beneath a first squeeze roller. The perforate conveyor belt may travel entirely within the longitudinal tank or alternatively the belt may pass underneath the tank while the belt is not carrying the non-woven batt. The web is generally squeezed in a nip defined between the conveyor belt and the squeeze roller to remove fluid from the web. The conveyor then carries the web over a first singular or cooperating roller and to the next squeeze roller. The web, after being gently squeezed, expands significantly to absorb fluid in the longitudinal tank as the web passes from one squeeze roller, over the intermediate cooperating roller and to the next squeeze roller. The conveyor belt repeatedly carries the web alternately beneath a squeeze roller and above a cooperating roller throughout the longitudinal tank to repeatedly squeeze the web. Fresh fluid may be supplied to the tank by way of one or more orifices positioned above the tank or alternatively fluid may be supplied from a collecting tank which is located beneath the longitudinal tank. The fluid generally travels in a direction opposed to the direction of travel of the web to continuously provide relatively fresh fluid for the web throughout the longitudinal tank.

BRIEF DESCRIPTION OF THE DRAWINGS

In order that the invention may be more readily understood, reference is made to the accompanying drawings in which like numerals refer to like elements and in which.

DESCRIPTION OF THE PREFERRED EMBODIMENTS

The process of the present invention is intended to achieve a high degree of "liquor-for-air exchange" efficiency for wet-on-dry impregnations and a high degree of "liquor B-for-liquor A exchange" efficiency for wet-on-wet impregnations, washes or rinses for heavy-weight nonwoven fiber batts in a manner which will not significantly disrupt, tear or rupture the batt and which will significantly reduce the number of pairs of high expression nip rolls, conveyor belts, liquid circulation pumps and agitators, etc., which would otherwise be needed. The "ideal" wet-on-dry impregnation process is one which will replace air or other gases (entrained in the dry fiber batt entering the impregnation vessel) with treating liquor completely in a relatively short time., i.e., on the order of a few seconds. And, the "ideal" wet-on-wet impregnation, wash or rinse process for our purposes is one which will replace a liquor A (which is entrained in the wet fiber batt entering impregnator) with liquor B contained in the impregnator, completely in a relatively short time, i.e., on the order of a few seconds. The "ideal" process in either case will not disrupt nor entangle fibers in the batt, nor weaken, tear or rupture the batt as the batt passes through the process. Although it is recognized that any actual, real process is not likely to achieve the perfection sought in the ideal process, the improved process of the present invention approaches the ideal process more effectively and with simpler, less expensive means than any other known process or apparatus.

Although the process of the present invention may be utilized in any process requiring a liquid impregnator, rinser or washer, it is hereinafter described in conjunction with a representative cotton fiber treatment.

Figure 1:
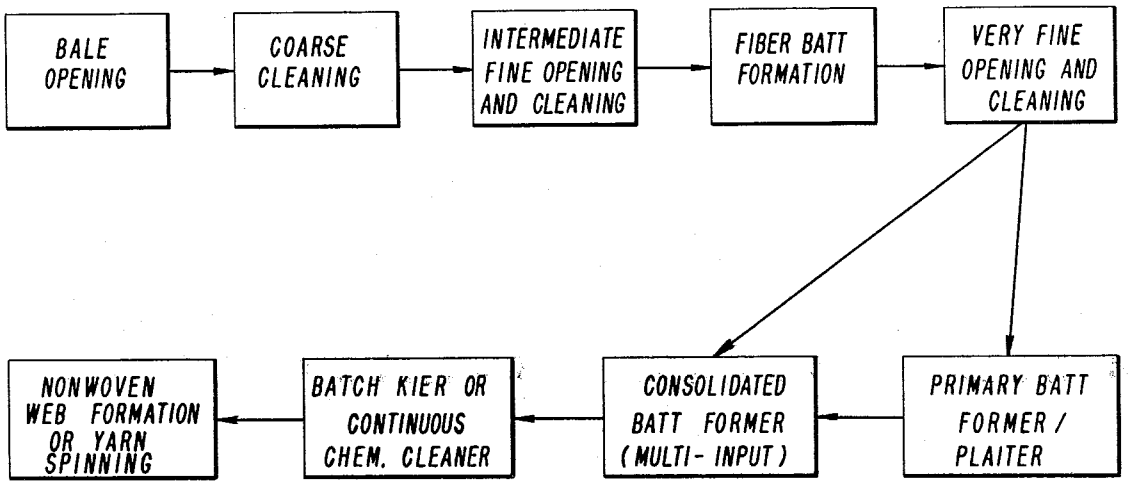
FIG. 1 is a schematic flow diagram of stages of representative cotton fiber treatment system utilizing the processes and apparatus of the present invention to provide continuous chemical cleaning.

Referring to FIG. 1, a schematic flow diagram is shown of stages of a representative cotton fiber treatment system utilizing the processes and apparatus of the present invention to provide fiber batt formation.

First, greige cotton bales are segregated according to quality grades and/or cotton varieties or selections, with particular regard to trash (non-lint) content, and if pertinent by fiber length, strength and micronaire characteristics.

Bale opening may be accomplished by a gross bale opener of suitable design, the function of which is merely that of opening up the baled fiber from the relatively high density characteristic of incoming compressed baled fiber to smaller fiber aggregates of lower density, thereby facilitating the controlled automatic feed of the fiber to subsequent coarse opening and cleaning stages. The subsequent coarse opening and cleaning stages consist of one or more sub-stages of coarse opening and cleaning equipment such as an inclined step cleaner or other known fiber cleaners such as manufactured by Fiber Controls Corporation. Fiber leaving one or more coarse opening and cleaning stages may then be conveyed to one or more stages of intermediate fine opening and cleaning equipment such as the known Shirley opener-cleaner and/or opener-cleaners such as a Fiber Controls model 310 fine opener-cleaner or a Fiber Controls model C60 opener-cleaner.

Controlled uniform fiber feed transfer from the intermediate fine opening and cleaning stages is next achieved by fiber batt formation to satisfy the high fiber mass feed rate and fiber area density feed uniformity desired for efficient operation of a very fine opening and cleaning fiber treatment unit. Such a fiber batt may be formed using a modified fiber feed chute known for conventional textile carding feed systems, or the fiber may be discharged onto one or more condenser cylinders from which a more uniform batt of desired density can be removed or "doffed".

The very fine opening and cleaning stage consists of a further removal of foreign material from the formed batt. Output from the very fine opening and cleaning stage may, if desired, be passed directly to a chemical cleaning operation. Preferably, the output from the very fine opening and cleaning stage is first subjected to a primary batt forming stage, which may be followed by a plaiting stage if desired, and two or more of these webs may then be plied or otherwise combined to form a consolidated batt of desired weight (area density) and fiber blend ratios. The consolidated batts so formed, either batch, semi-continuously or continuously, serve as a uniform batt feed supplied to a continuous chemical cleaner or to a fiber opener to feed a batch kier for preparation of cleaned cotton fiber for non-woven or yarn spinning operations.

The continuous chemical cleaning state may be accomplished utilizing the process and apparatus of the present invention as more fully described herein.

Figure 2:
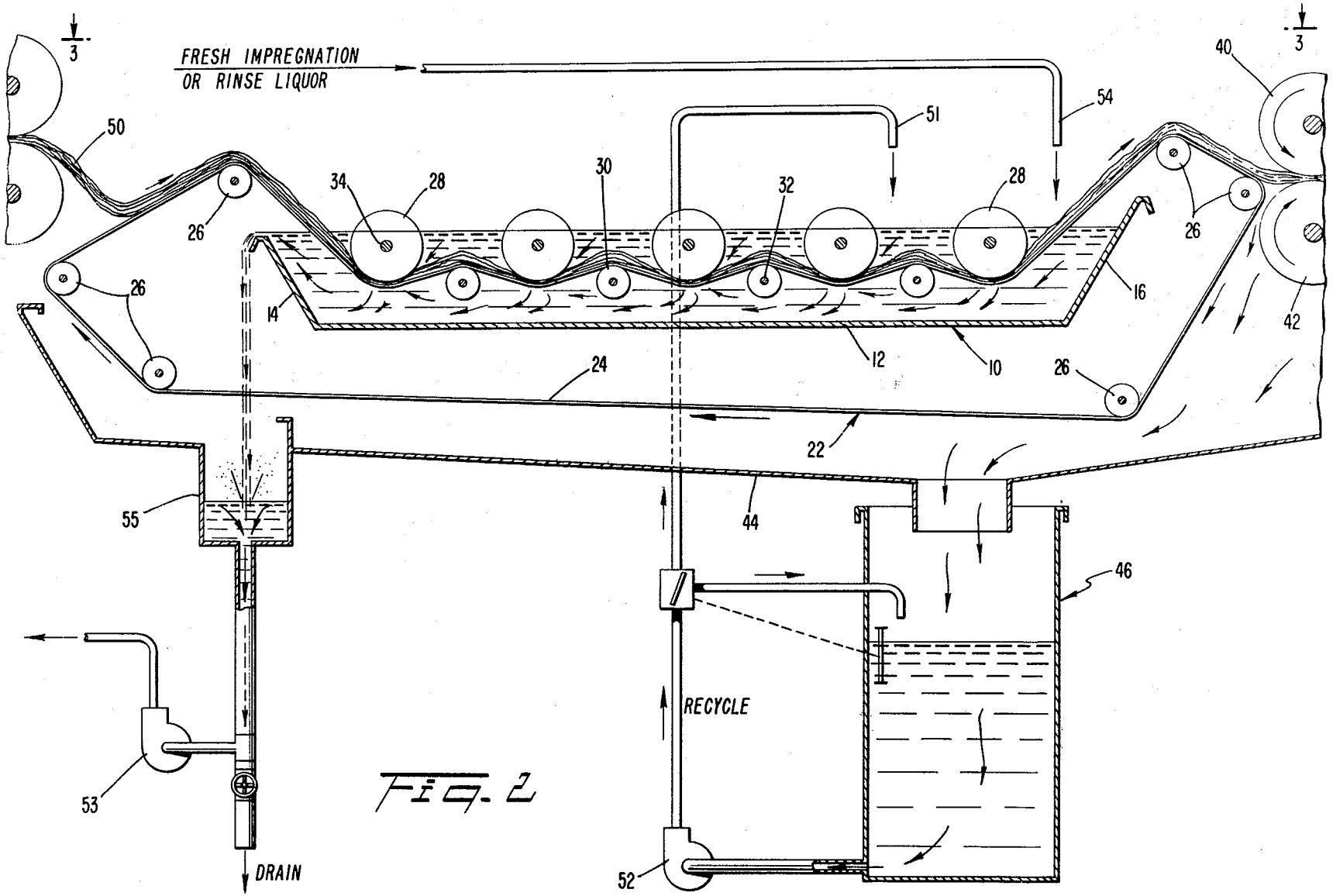
FIG. 2 is a side view in partial cross section of a first embodiment of an apparatus for continuous chemical cleaning according to the present invention.

With reference now to FIG. 2 of the drawings, a first embodiment of the apparatus of the present invention which may preferably be used as a rinser for the non-woven batt includes a longitudinal tank 10 having a bottom member 12 and a pair of end walls 14,16. A pair of side walls 18,20 (see FIG. 3) are joined both to the end walls and to the bottom member to form a container for fluid which is substantially longer than the width of the tank.

In this embodiment it may be desirable to provide a countercurrent flow for the fluid within the tank. Accordingly, the end wall 14, which forms a front wall for the tank, is lower in height than the other end wall 16 which forms a back wall for the tank. When the tank is supplied with fluid, the fluid will flow over the front wall 14 before flowing over the back wall 16. The said walls 18,20 each include a top edge which extends from the top of the front wall to the top of the back wall such that the upper liquid level of fluid will be effectively contained in the tank as it flows by gravity in a generally horizontal fashion which is inclined downwardly towards the front wall 14.

A perforate endless conveyor 22 includes a belt 24 which travels in a continuous path around the longitudinal tank 10. In the arrangement of the first embodiment shown in FIG. 2, the belt 24 travels on a plurality of rollers 26 arranged below and at either end of the longitudinal tank. One or more of the rollers 26 is connected by suitable gearing (not shown) to an electric motor (also not shown) to provide a driving force for the belt 24. The belt travels in a generally clockwise direction (see FIG. 2) with the belt moving from the front wall 14 towards the back wall 16 within the longitudinal tank.

A series of squeeze rollers 28 are arranged within the tank in a generally planar configuration with each of the rollers 28 being cylindrically shaped and having an axis 34 which is transverse to the direction of travel of the belt 24. All of the axes of the squeeze rollers are parallel both to one another and to the bottom member 12 of the tank. The axes 34 are mounted at either end in the side walls 18,20 of the tank to permit each squeeze roller to freely rotate about the respective axis.

With reference also to FIG. 2, the belt 24 conveys a non-woven batt 50 from an immediately preceeding stage in a fiber treatment process such as a consolidated batt forming stage into the longitudinal tank over the front end 14. The batt 50 is carried throughout the longitudinal tank on an upper surface of the belt 24 so that the batt is always above the belt.

With reference again to FIG. 2, a series of singular or cooperating rollers 30 are arranged within the tank in a generally planar configuration spaced alternately between the squeeze rollers 28. Each of the cooperating rollers 30 is cylindrically shaped and has an axis 32 which is transverse to the direction of travel of the belt 24. The cooperating rollers are oriented with the squeeze rollers so that a top surface of each of the cooperating rollers is both between adjacent squeeze rollers and above lower surfaces of the adjacent squeeze rollers. In this way, the number of cooperating rollers is one less than the total number of squeeze rollers. In the first embodiment, four cooperating rollers and five squeeze rollers are provided within the tank.

All of the axes 32 of the cooperating rollers are arranged parallel to one another and parallel to the axes 34 of the squeeze rollers. The axes 32 are mounted at either end in the side walls 18,20 of the longitudinal tank to permit each cooperating roller to freely rotate about each axis. Alternatively, both the squeeze rollers and the cooperating rollers may be mounted on an adjustable frame (not shown) to permit relative vertical movement of the squeeze rollers both with respect to each other and with respect to the cooperating rollers.

The belt 24 travels in a winding path alternately beneath the squeeze rollers and above the cooperating rollers. After passing above the front end 14 of the tank, the belt 24 carries the batt 50 beneath the first squeeze roller 28 where the web is gently squeezed in a nip defined between the belt and the roller. The perforations of the belt permit a large fraction of the fluid which has been absorbed by the batt to be squeezed out of the batt. Generally, the squeeze roller 28 reduces the gross wet fluid volume contained in the batt to about 1/5 or about ½ of the unsequeezed gross wet fluid volume, and more frequently from about ¼ to about ⅓, without substantially detrimentally affecting the cohesiveness of the non-woven batt. Immediately after the batt has passed beyond the first squeeze roller the batt then absorbs additional fluid to replace that fluid removed during squeezing.

The batt 50 is now conveyed by the belt upwardly towards the first cooperating roller 30. During the travel of the batt between the first squeeze roller, over the first cooperating roller and to the second squeeze roller, the batt becomes completely saturated with fluid.

Figure 5:
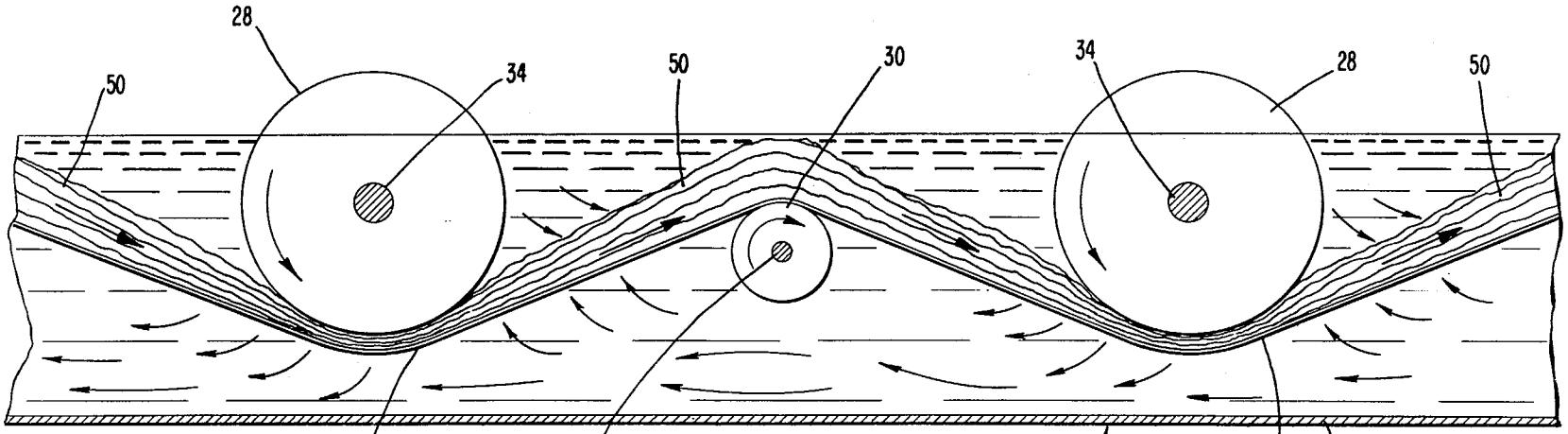
FIG. 5 is an enlarged side view of a series of squeeze rollers and a series of cooperating rollers showing the plaited web being compressed and allowed to absorb liquid as it is carried by the endless conveyor.

With reference now to FIG. 5, the travel of the batt 50 under the first squeeze roller 28 reduces the cross sectional thickness of the batt as a result of forces exerted by the belt 24 in a direction towards the axis 34 of the squeeze roller. As the belt passes beneath the squeeze roller, a tension provided throughout the entire length of the belt is comprised of tangential and radial components with the radial component reaching a maximum value at a lowermost portion of the squeeze roller. It is at the lowermost portion of the squeeze roller, therefore, that the batt undergoes the greatest compression between the belt 24 and the surface of the squeeze roller 28. After the batt has traveled beyond the lowermost portion of the squeeze roller, the radial component of force exerted by the belt on the web decreases. The radial component of force is equal to zero when the batt is no longer in contact with the surface of the squeeze roller.

As the batt is carried by the belt 24 from squeeze roll 28 to the adjacent cooperating roller, the batt is free to readily absorb fluid from the longitudinal tank. The cross sectional thickness of the batt increases to a maximum extent when the batt is completely saturated with fluid. The cooperating rollers enable the belt to obtain a desired radial component of force while traveling beneath the series of squeeze rollers without requiring an extremely high degree of tension on the belt.

As the batt is conveyed throughout the longitudinal tank, the batt is repeatedly squeezed while passing between a squeeze roller and the conveyor belt 24. As represented by the increased thickness of the batt in FIG. 5, the batt is allowed to absorb fluid between the series of intermittent squeezes and becomes completely saturated while passing between successive squeeze rollers.

After passing over the first cooperating rollers, the batt is conveyed beneath the second squeeze roller where the fluid is substantially removed from the batt as it is gently squeezed between the belt and the squeeze roller in the same manner and amount as described above. From the squeeze roller, the batt is conveyed to another cooperating roller with the non-woven batt again absorbing the liquid in the tank 10 in the manner and amounts as described above, and vice versa throughout the length of the longitudinal tank.

An important aspect of the present invention is achieving the significant increase desired in impregnation and rinsing efficiencies for a non-woven batt is the inclusion of a series of gentle repetitive squeezing actions applied to the batt while it is immersed in and traveling through the impregnation liquid. Each gentle squeezing action expresses a large fraction of the liquid contained by the non-woven batt while it is immersed. The subsequent release of squeezing pressure while the batt is still immersed in the treating or rinsing liquid then draws large fractions of fresh treating or rinsing liquor into the fiber batt, thereby increasing the liquor interchange within the batt. By subjecting the batt to a series of gentle squeezing pressures with intermediate removal of such pressures between squeezing positions, where both application and release of pressure occurs while the batt is immersed in the liquor, a highly efficient impregnation and/or liquor exchange can be obtained without damaging, tearing or rupturing the batt and without the need to use pairs of nip rollers to express the liquor between immersion dips.

Although two submerged squeezes are significantly better than one for improving the liquor exchange within the batt, three submerged squeezes are better than two, and four are better than three. Any number of from at least 3 and up to roughly 20 submerged gentle squeezing actions applied to the batt increase the efficiency of liquor impregnation, washing or rinsing to a very high degree. However, for most purposes, from 4 to 10 such gentle cycles of applied and released submerged squeezing pressure are sufficient for most non-woven fiber batt treating purposes.

From the last squeeze roller, the batt is carried by the belt up over the rack end 16 of the tank to a pair of high-expression nip rolls 40,42 which remove most of the fluid from the batt before the web leaves the apparatus of the present invention. Generally, depending upon the next treatment to which the non-woven batt will be subjected, the nip rolls will remove the fluid in the batt to a level of from about 60% to about 300%, WPU, preferably from about 80% to about 150%, WPU (meaning 0.6 to about 3 pounds of liquor per pound of dry fiber in the batt, preferably from about 0.8 to about 1.5 pounds of liquor per pound of dry fiber in the batt).

Figure 3:
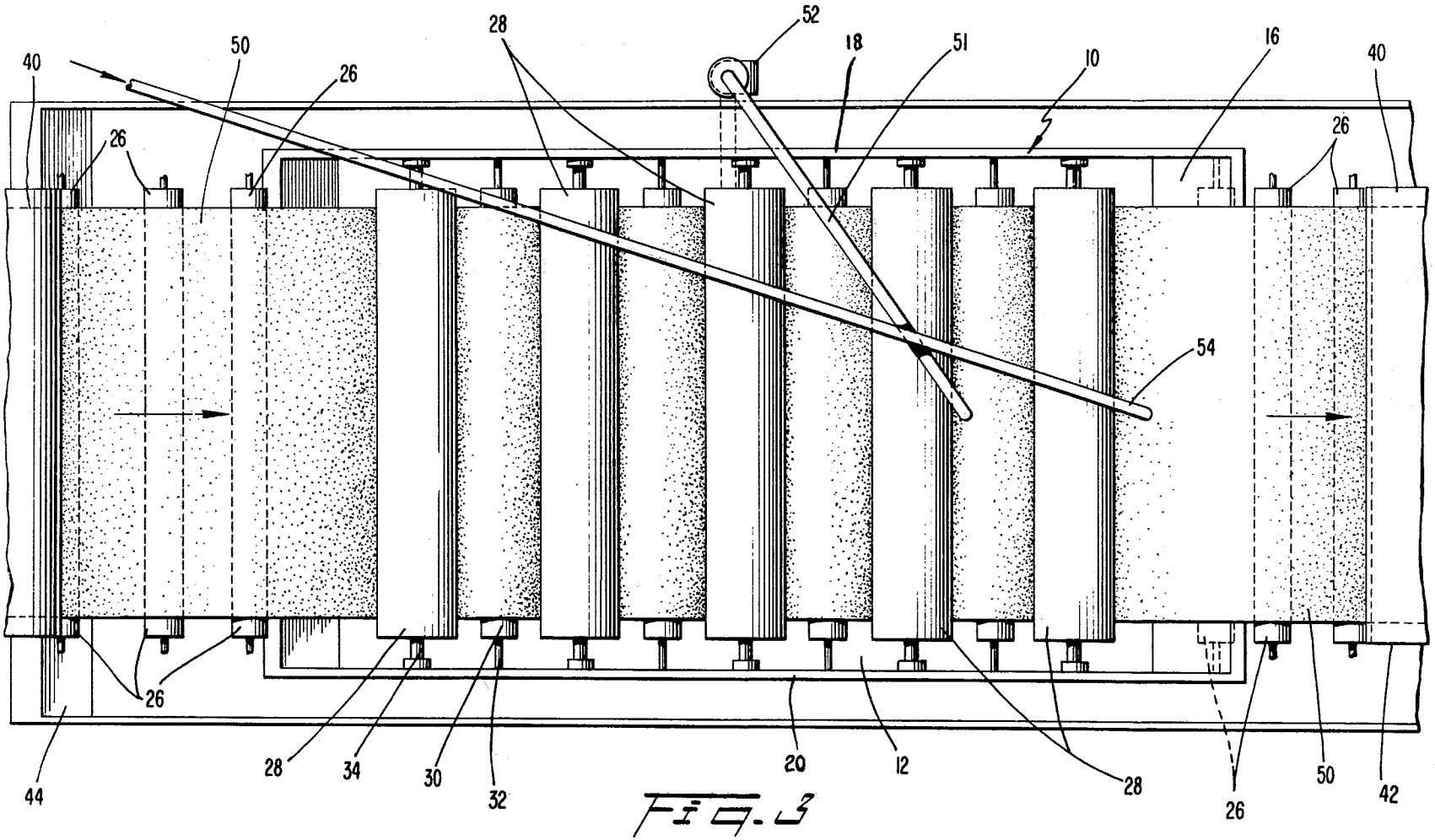
FIG. 3 is a top view taken along lines 3—3 of FIG. 2 showing the arrangement of rollers with the web within the tank of the present invention.

With continued reference to FIGS. 2 and 3, a collecting pan 44 which is located beneath both the longitudinal tank 10 and the conveyor 22 receives fluid which is removed from the batt by nip rollers 40,42. This fluid is recycled to the longitudinal tank 10 via a sump 46, a pump 52 and a piping system 51 with the discharge orifice of 51 positioned preferably closer to end wall 16 of the longitudinal tank 10 to enhance countercurrent flow from the back wall 16 to the front wall 14. Since the front wall 14 of the longitudinal tank 10 is lower than the back wall 16, fresh liquor supplied by the orifice 54 also travels in a direction which is opposite to that of the moving batt within tank 10. Accordingly, a significant counterflow is obtained wherein the batt is progressively exposed to fresher fluid as the batt travels through the tank. When the apparatus is used as a rinser, fresh rinse liquor added to the tank through the orifice 54 flows generally countercurrent to the direction of the batt movement and overflows into a trough 55 connected either directly to the drain by gravity flow or, alternatively, to the inlet of a pump 53 from which a rinse effluent from tank 10 may be pumped to drain or countercurrent to another upstream rinsing stage. Alternatively, if the apparatus is used as an impregnator to apply a treating liquor (such as a bleach or dye liquor), the trough 55 and the pump 53 are not required.

Figure 4:
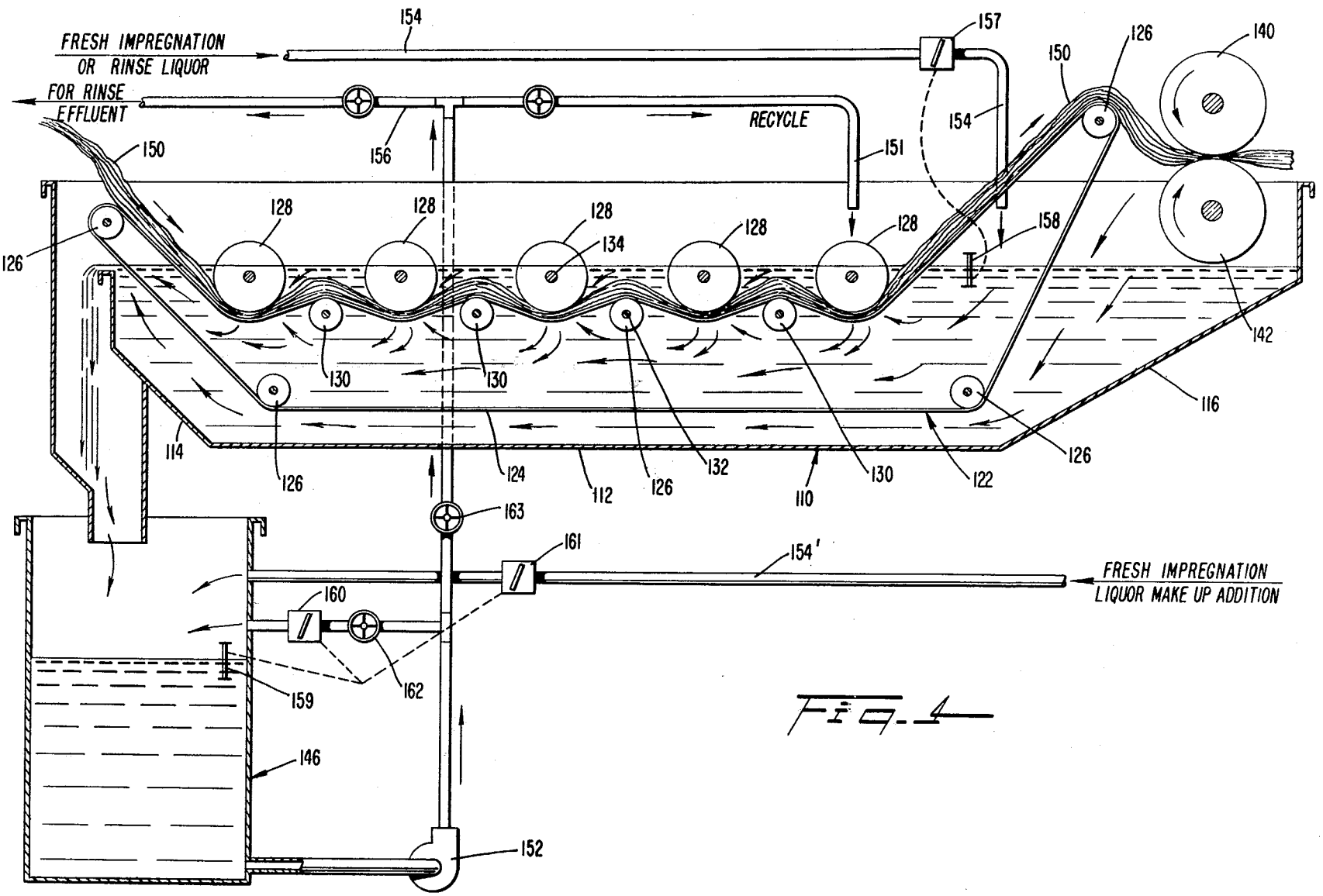
FIG. 4 is a side view in partial cross section of a second embodiment of an apparatus for continuous chemical cleaning according to the present invention.

With reference now to FIG. 4, a second embodiment of the present invention, which may be used as either a rinser or as an applicator of, for example, dye to the non-woven batt, includes a longitudinal tank 110 having a bottom member 112 and a pair of end walls 114,116. A pair of side walls 118,120 (shown as hatched lines) are joined both to the end walls and to the bottom member to form a container for fluid which is substantially longer than the width of the tank.

Referring again to FIG. 4, depending on the intended use of the present apparatus, for example as an impregnator or as a rinser, auxiliary liquor input and effluent piping and flow arrangements may be easily altered to enable the impregnator/rinser to serve more effectively as either an impregnator or as a rinser. When the apparatus is used simply as a rinser, fresh rinse liquor may be added directly to the tank 110 via a piping system 154 without the need for a liquid level control device 158 connected to a liquor flow control valve 157. And, if there is no need to reuse the spent rinse liquor effluent which spills over a weir at the front end 114 of the tank 110, the spent rinse liquor effluent may flow by gravity directly to a sewer drain, or, alternatively as shown in FIG. 4, into a sump 146 from which it may be pumped through a heat exchanger. If the rinse effluent is to be reused (e.g., as in the case of a bleach rinse effluent to serve as a rinse liquor for an up-stream alkali rinsing stage), then the rinse effluent may be pumped to another rinsing stage. In any alternative in which the sump 146 is employed in the discharge of the rinse effluent from the apparatus shown in FIG. 4, the rinse effluent may be transfered from the sump 146 through a piping system 156 using a pump 152, in which case it is desirable to use a level control device 159 and a sump recycle control valve 160 to protect the pump 152. In any alternative piping arrangement described above for use with the apparatus when it is used as a rinser, good generalized counter-current flow is achieved with the gross mass flow rate of rinse liquor entering tank 110 through the piping system 154 nearer the back wall 116, and flowing by gravity within the tank 110 in a path leading to the overflow wier at the top edge of front wall 114. Hence a concentration gradient is maintained within tank 110 with fresher, cleaner rinse water nearer the back wall 116 of tank 110, and dirtier, spent rinse water near the front wall 114 of tank 110.

When the apparatus shown in FIG. 4 is used simply as an impregnator for applying scouring, bleach or dye liquor, etc., fresh makeup liquor may be added directly to tank 110 via the piping system 154 using the liquor level control 158 in the tank 110 to open and close the control valve 157, in which case the sump 146 and associated piping need not be employed. However, it may often be preferable to employ the sump 146 for better control and mixing of fresh impregnation liquor makeup, in which case the fresh makeup liquor is supplied to the sump 146 through an alternative piping system 154', employing a liquor level control device 159 to open and close a control valve 161. The liquor in the sump 146 is constantly being mixed by recycle circulation through the pump 152 and a manual resistance valve 162, while a portion of the liquor from the pump 152 passes through a manual resistance valve 163 into the tank 110 via a piping leg 151. Since the level control device 159 is used in this case to open and close the control valve 161, the manual resistance valve 162 replaces the automatic control valve 160 in order to establish a flow ratio of liquor recycling directly back to the sump through the resistance valve 162 versus the amount flowing into the tank 110 through the resistance valve 163 and the pipe leg 151.

With continued reference to FIG. 4, a perforate endless conveyor 122 includes a belt 124 which travels in a continuous path within the longitudinal tank 110. Immediately above the bottom of the tank, the belt 124 travels on a plurality of rollers 126 arranged at spaced intervals. One or more of the rollers 126 is connected by suitable gearing (not shown) to an electric motor (also not shown) to provide a driving force for the belt 124. The belt travels in a generally clockwise direction within the tank with the belt moving from the front wall 114 towards the back wall 116 and then returning to the front wall along the bottom of the tank.

A series of squeeze rollers 128 are arranged within the tank in a generally planar configuration with each of the rollers 128 being cylindrically shaped and having an axis 134 which is transverse to the direction of travel of the belt 124. All of the axes of the squeeze rollers are parallel both to one another and to the bottom member 112 of the tank. The axes 134 are mounted at either end in the side walls 118,120 of the tank to permit each squeeze roller to freely rotate about the respective axis.

The belt 124 conveys a non-woven batt 150 from an immediately preceeding stage in a fiber treatment process such as a consolidated batt forming stage into the tank over the front end 114. The batt 150 is carried on an upper surface of the belt 124 so that the batt is always above the belt.

A series of cooperating rollers 130 are arranged within the tank in a generally planar configuration below the squeeze rollers 128. Each of the cooperating rollers 130 is cylindrically shaped with a cross sectional diameter which is preferably less than a cross sectional diameter of a squeeze roller 128, and has an axis 132 which is transverse to the direction of travel of the belt 124. The cooperating rollers are oriented with the squeeze rollers so that each of the cooperating rollers is located between adjacent squeeze rollers, with the axis of each squeeze roller located above the axis of each cooperating roller. However, the top surface of each cooperating roller is above the bottom surface of each corresponding squeeze roller.

In this embodiment, five squeeze rollers and four cooperating rollers are alternately arranged throughout the longitudinal tank. However, more or fewer rollers to provide from at least 3 and up to roughly 20 submerged gentle squeezing actions are desirable.

Depending upon the specific magnitude and duration of radial force desired, the vertical spacing of the upper portions of the cooperating rollers with respect to the lower portions of the squeeze rollers may be varied. Additionally, the magnitude of the diameters of the squeeze rollers and the cooperating rollers may be varied to obtain many different arrangements. For example, the series of squeeze rollers may include rollers which alternately have large and small radii so as to provide squeezes of alternately short and long duration.

A pair of high expression nip rolls 140,142 are positioned at the end of the tank to remove most of the fluid from the batt. This fluid is returned directly to the tank by positioning the rolls 140,142 in front of the back wall 116. Generally depending upon the next treatment to which the non-woven batt will be subjected, the nip rolls will remove the fluid in the batt to a level of from about 60% to about 300%, WPU, preferably from about 80% to about 150% WPU.

The process of the present invention is particularly effective on non-woven batts which possess a sufficiently large thickness dimension normal to the plane in which the batt is traveling, and a sufficiently large degree of wet resilience for alternating compression and recovery as the gentle, compressional squeezing forces are alternately applied and released as the batt passes under and over the rolls described above.

If the batt is too thin or too dense (such as is generally the case with woven fabrics), then the process is no longer as significantly effective. Hence the non-woven batt preferably should weight over 4 oz/square yard, most preferably over 8 oz/square yard (dry fiber basis for conventional textile fibers such as cotton, wool and conventional synthetic fibers). The bulk density of the fiber batt (dry fiber basis) should preferably be less than 30 pounds per cubic foot in the relaxed homogeneous state. Depending on the type of liquid treatment desired, the liquid in the tank 10 or the tank 110 may be, for example, water, alkaline scouring liquor, dye bath or other chemical treating baths.

SUMMARY OF ADVANTAGES OF THE PRESENT INVENTION

The new impregnator/rinser as disclosed herein employs a single endless conveyor belt which enters one end of a relatively long and shallow and relatively horizontal impregnation vessel, and which belt passes over one series of cooperating rolls and under another series of squeeze rolls. Each roll is positioned with the rotational axes of all of the rolls in the series over which the conveyor belt passes lying essentially in one horizontal plane, and the rotational axes of the combined series of rolls being also essentially parallel to each other and relatively close to each other, or they may actually coincide in one essentially horizontal plane. Such a spaced configuration of the turn rolls (within-and-between each series of turn rolls) allows one (a) first to control the movement of loose staple fiber (or of non-woven staple fiber batts characterized by low fiber to fiber cohesion or adhesion) in a continuous, uninterrupted path through the impregnation or rinsing liquid contained in the impregnation vessel, and (b) also to do so by means of only one endless conveyor belt, and thereby to convey the loose fiber or non-woven batt (resting upon or supported by only one conveyor belt as the batt and the belt pass alternately over one roll and then under the next roll, then over the next roll, and so on) continuously over and under the entire sequence of turn rolls throughout the entire length of the impregnation vessel. With such a spaced configuration of the turn rolls so employed to guide the travel motion of the loose fiber or batt as it is conveyed on the top of a single conveyor belt it is also possible to obtain an effective degree of controlled intermittent application and relaxation of squeezing pressure against the surface of the loose fiber or non-woven batt to obtain good impregnation and expression of treating or rinsing liquid, all without the need to employ nipping means such as pairs of squeeze rolls or opposed pressure plates which otherwise are used for such purposes.

For loose fiber or non-woven fiber batt processing purposes in which the fiber is treated in a series of wet processing and drying stages, it is advantageous (a) to maintain the integrity and uniformity of batt area and linear densities as the fiber is conveyed through each wet processing or drying stage in order that each treating stage process treatment can be carried out more efficiently with less energy and less consumption of liquid media and treating chemicals, and (b) to maintain sufficient cohesion of the batt to facilitate fiber transfer fron one liquid impregnator or rinser to the next in a continuous multi-stage process sequence. The design features of the impregnator/rinser of the present invention provide the means for applying all such treatments to loose staple fiber or to nonwoven batts formed from such fiber without significant disruption of the integrity and uniformity of the fiber batt linear and area densities as the fiber is conveyed as a continuous batt, first over a cooperating roll and then under a squeeze roll, throughout the entire series of rolls composed of cooperating rolls alternately spaced between squeeze rolls.

It is also highly desirable to retain the freedom of conveyor belt design to permit the selection and use of open porous belts fabricated at low cost from economical materials; and hence it is essential that such conveyor belts are not required to pass through the pressure nips formed between two or more squeeze rolls or pressure plates. It is also preferred that only one conveyor belt be used to support and convey the fiber batt as it travels over and under the sequence of cooperating rolls and squeeze rolls. In this fashion a wide range of preferred open wire mesh belt designs may be used on only the underside of the fiber batt. And in this manner such conveyance means avoids objectionable compressive interaction between two such wire mesh conveyors against each other and against the fiber batt, which otherwise would be the case if an upper and a lower belt were used to contain and control the movement of the fiber batt as it is conveyed over and under a series of rolls and/or between the nips of paired squeeze rolls. Such interaction between two belts (for example, open wire mesh belts) rubbing compressively against the fiber batt and/or against each other would damage the fiber batt and also inflict excessive wear on the belts and turn rolls.

The alternating squeezing compression and relaxation expansion of the fiber batt may be effectively carried out by the new and innovative impregnator/-rinser in which only one endless conveyor belt need be used to transport the fiber batt and in a fashion which does not require the use of one or more pairs of nip rolls or pressure plates to obtain effective impregnation or rinsing liquor exchange into and out of the fiber batt, and in a fashion which readily facilitates counter current flow of treating liquors throughout the length of the impregnation vessel in essentially a horizontal flow from the liquor input end of the vessel to the liquor discharge end of the vessel without the need to employ auxiliary pumping means between the input liquor port and the discharge liquor port to cause such counter current flow.

By means of the novel process of the present invention, the fiber batt is effectively compressed between a turn roll and a single endless conveyor belt in such a fashion that (a) there is no significant dragging friction and wear between the conveyor belt and the turn rolls (or any other cooperating rolls or compressive surfaces) as compressive forces are applied normal to the face of the fiber batt; and, (b) the fiber batt is not under tension; and, (c) there is no mussing or disarrangement of the fiber web or batt formation during successive and alternating compressive squeezings and relaxing expansions of the batt as it passes through the impregnating liquor.

Furthermore, the use of objectionable sprays are avoided as devices for forcing fresh liquor into the batt. Sprays are objectionable since they also muss and disarrange the fiber in the batt, and they require additional pumps and maintenance of equipment. Since at no time is the conveyor belt of the impregnator/rinser of the present invention required to pass between nip rolls or to pass over, under, or between fixed (i.e., motionless) surfaces in rubbing contact, the life of the conveyor belt is extended to a very large degree, and also the freedom to use preferred, economical, open wire mesh conveyor belts designs is feasible. And further, by avoiding the need to pass the conveyor belt between the pressure nip of two or more squeeze rolls, the conveyor belt tension may be adjusted by one simple tensioning device at one position in the endless conveyor belt path; and thereby the tension applied to the belt along the entire length of belt travel through the impregnator may be controlled; and hence thereby the compressive pressure applied by the conveyor belt against the fiber batt at each squeeze roll position may be controlled.

Furthermore, the use of many repetitive compressive paired nip roll actions (required by prior art means to obtain good liquid interchange into and out of such fiber batts) is highly objectionable where a series of wet processing stages with intermediate fiber transfer zones are needed in the total continuous processing system since each passage of the batt through a pair of nips tends to draft or elongate the batt. An excessive number of such incremental elongation drafts will eventually rupture the batt making further transfer from one conveyor belt zone to the next difficult (without stopping the belts and hence interrupting the smooth continuous flow of fiber batt through the processing system). The new impregnator design of the present invention avoids the use of paired squeeze roll nipping actions to accomplish effective treating and/or rinsing liquor exchange in the impregnation vessel; and hence the new impregnator design is much preferred for applying treating or rinsing liquors to such nonwoven fiber batts.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A method of impregnating a moving fibrous batt with fluid by intermittently squeezing the batt, the method including the steps of:

conveying the moving batt in a generally longitudinal direction within a longitudinal tank of fluid on a single endless conveyor belt, the batt being arranged on an upper surface of the belt;

gently squeezing the batt while within the fluid in a nip defined between a first squeeze roller and the endless conveyor belt by passing the web and belt below the first squeeze roller provided within the tank;

carrying the batt on the conveyor belt above a singular roller to permit the batt to absorb fluid while within the fluid;

intermittently gently squeezing the batt by passing the batt alternately between at least one other squeeze roller and the belt and above both the batt and at least one other singular roller; and conveying the batt from a squeeze roller out of the longitudinal tank.

2. The method of claim 1 further comprising the step of:

arranging the series of squeeze rollers in a generally planar arrangement with the squeeze rollers parallel with one another.

3. The method of claim 2 further comprising the step of:

arranging the series of singular rollers in a generally planar arrangement with the singular rollers parallel with one another.

4. The method of claim 1 further comprising the step of:

supplying fluid to the longitudinal tank.

5. The method of claim 4 further comprising the step of:

maintaining a predetermined level of fluid within the tank, the fluid being maintained at a level above the top of the squeeze rollers.

6. The method of claim 4 further comprising the step of:

collecting fluid from the longitudinal tank in a collection tank arranged beneath the longitudinal tank.

7. The method of claim 6 further comprising the step of:

pumping fluid from an outlet of the collection tank to the longitudinal tank.

8. The method of claim 1 further comprising the step of:

providing a flow of fluid within the longitudinal tank opposed to the general direction of travel of the batt within the tank.

9. The method of claim 1 further comprising the step of:

removing fluid from the batt as the batt is conveyed away from the tank, the batt being conveyed through a pair of nip rollers.

10. The method of claim 1 wherein the batt is allowed to expand and absorb fluid during the entire travel of the batt between adjacent squeeze rollers.

* * * * *